US005108268A

United States Patent [19]

Divall

[11] Patent Number: 5,108,268

[45] Date of Patent: Apr. 28, 1992

[54] PUMPS

[75] Inventor: John E. Divall, Wantage, England

[73] Assignee: CMB Foodcan plc, Worcester, England

[21] Appl. No.: 554,898

[22] Filed: Jul. 20, 1990

[30] Foreign Application Priority Data

Jul. 24, 1989 [GB] United Kingdom ..... 8916883

[51] Int. Cl.[5] ..... F04B 1/12; F01B 3/00; F01D 11/04

[52] U.S. Cl. ..... 417/269; 91/499; 415/110

[58] Field of Search ..... 415/110; 417/269, 271, 417/440; 91/499

[56] References Cited

U.S. PATENT DOCUMENTS

| | | | |
|---|---|---|---|
| 2,517,483 | 8/1950 | Haut | 417/269 |
| 3,468,263 | 9/1969 | Niemiec | 91/499 |
| 3,521,532 | 7/1970 | Espig | 91/499 |
| 3,616,727 | 11/1971 | Suzuki | 91/499 |
| 3,799,033 | 3/1974 | Pruvot | 91/499 |
| 4,007,663 | 2/1977 | Nagatomo | 417/269 |

FOREIGN PATENT DOCUMENTS

| | | | |
|---|---|---|---|
| 1199600 | 7/1970 | United Kingdom | 91/499 |

*Primary Examiner*—Richard A. Bertsch

*Assistant Examiner*—Peter Korytnyk

*Attorney, Agent, or Firm*—Watson, Cole, Grindle & Watson

[57] ABSTRACT

A pump suitable for food products containing solid pieces has a rotary turret (11) incorporating four piston and cylinder pumping units (15) spaced uniformly around the rotation axis. The pistons are reciprocated by a stationary cam (8) and have associated with them rolling diaphragms (35) which separate pumping chamber (40) from chamber (41) which are connected to a vacuum source. The cylinders are closed by a rotor end member (50) journalled on a manifold member (60) and provided with fluid ports (51). A sealing ring (65) of low friction material forms a seal with the end face of member (50) and includes slots for connecting the ports (51) alternately to supply and discharge conduits (55, 56) for the product passing through the pump. The sealing interface between member (50) and ring (65) is surrounded inwardly and outwardly by a cavity for receiving barrier fluid, e.g. steam, under pressure. The manifold member (60) can be raised by operating a handwheel (84) to separate the sealing faces to facilitate cleaning/sterilization. In a modified embodiment the rotor end member include passages for interconnecting the pumping chambers during cleaning/sterilization periods, a valve assembly being provided for opening and closing these passages.

36 Claims, 7 Drawing Sheets

PUMPS

This invention relates to pumps. The invention aims specifically at a pump suitable for handling aseptically food products, including particulate products, and capable of taking such products at high pressure from a heat treatment plant and delivering the products at low pressure to machinery for filling the products into containers. It is to be understood, however, that the pump of the invention can also be used for other applications and it may be employed for more usual pumping duties in which fluid is pumped from a lower pressure to a higher pressure.

For reasons of hygiene, machinery handling food products must be cleaned regularly and effectively. Substantial cost savings can be made by reducing the downtime of the machinery for carrying out cleaning processes. For any piece of equipment, it is of advantage if it can be cleaned in place, ie. without needing to be dismantled. In the case of pumps this is often difficult to achieve due to the existence of small spaces and crevices into which the product may intrude and which are not easily flushed clean by cleaning solutions passed through the pump.

The pump specifically described herein has been designed with these considerations in mind and is capable of being effectively and efficiently cleaned and sterilized with minimal disassembly of the pump.

In accordance with a principle aspect of the present invention there is provided a pump comprising stationary cam means extending about an axis, a rotor assembly rotatable about the axis and including a plurality of pumping units distributed around the axis and having respective cam follower means cooperating with the cam means to be reciprocated substantially parallel to the axis for operating the pumping units upon rotation of the rotor assembly, the pumping units having pumping chambers with fluid ports opening at a sealing face and at a radial distance from the axis, and non-rotatable manifold means including a sealing member contacting the sealing face and having slots therein for communicating the ports with fluid supply and exhaust conduits as the rotor assembly is rotated.

A particular embodiment of the invention has four piston and cylinder pumping units uniformly distributed about the axis of the rotor assembly. The cylinders are axially fixed and the pistons are attached to piston rods guided for longitudinal movement in sleeves mounted on a support arrangement of the rotor assembly, the outer ends of the rods carrying cam follower rollers which run on an axially directed annular cam face of a stationary cam. Each piston and cylinder unit includes a rolling diaphragm partly confining the pumping chamber, and a closed chamber defined on the side of the diaphragm remote from the pumping chamber is connected to a vacuum source via an axial bore in a drive shaft of the rotor assembly and a through bore in a manifold member. The manifold member journals an end member of the rotor assembly which closes the upper ends of the pumping chambers and includes the fluid ports which open at an annular, planar end sealing face. The manifold member also supports a sealing ring of low friction material which is urged into sealing contact with the sealing face by resilient means, the sealing ring having two arcuate slots for communicating the ports with stationary fluid supply and exhaust conduits Cavities surround the sealing interface at its inner and outer perimeters, these cavities being confined by the end member of the rotor assembly, the sealing ring and the manifold member, and being equipped with means for delivering barrier fluid, in particular steam which condenses in the cavities, to be held in the cavities under pressure To facilitate cleaning/serialization of the contact faces of the sealing ring and the end member of the rotor assembly, the manifold is mounted to be displaceable in the axial direction for opening the faces apart, superheated water then being passed through the pump which is operated at low speed.

In a modified pump, which for the most part is similar to that described above, the rotor assembly includes means defining passages which can be opened to connect the pumping chambers together, whereby improved flow conditions are obtained for circulation of cleaning and/or sterilizing fluids. The passages allow a greater flow rate through the pump and can increase turbulence so that cleaning efficiency is improved. The passages are conveniently defined within the end member of the turret assembly which is provided with ports leading from a central bore provided in this member to the respective pumping chambers. A valve assembly is accommodated in the bore and includes a body with ports aligned with the aforesaid ports and extending outwardly from a central cavity. A valve member having the form of a piston normally takes a closed position in the valve cavity shutting off communication between the ports, but is axially retractable to open up such communication and hence establish free flow connection between the pumping chambers.

A better understanding of the invention will be gained from the following description of an exemplary embodiment, reference being made to the accompanying drawings, in which:

DETAILED DESCRIPTION OF THE PREFERRED EMBODIMENTS

Figure 1:
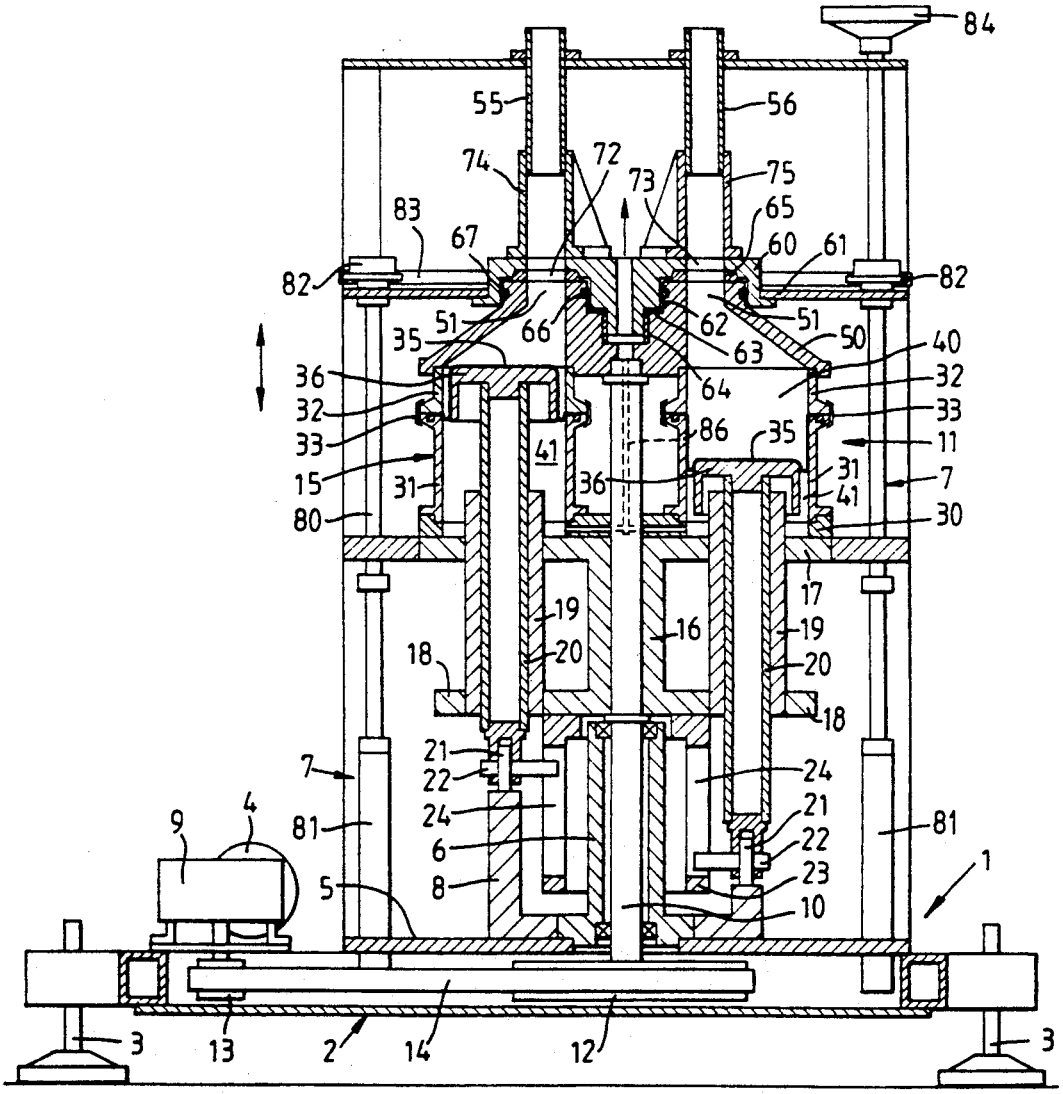
FIG. 1 is a schematic view, in axial cross-section, of a pump constructed in accordance with the invention.

The pump illustrated in the drawings comprises a frame 1 having a base 2 supported by adjustable feet 3 and mounting a drive motor 4 and worm reduction gear 9. The base includes a baseplate 5 on which are supported a central bearing housing 6, four upright support columns 7, and a stationary annular cam 8 extending coaxially around the bearing housing and defining an axially upwardly directed cam face. Journalled in the bearing housing 7 is a drive shaft 10 of a rotor assembly or turret 11. The lowermost end of the drive shaft 10 carries a sprocket wheel 12 which is driven by the motor 4 through the gear 9, a driving sprocket 13 and an endless chain 14 trained around the sprockets.

The rotary turret includes four piston and cylinder pumping units 15 uniformly distributed around the axis of the drive shaft and having their axes parallel to the rotation axis. A support hub 16 is keyed to the drive shaft and has fastened to it upper and lower flanges 17, 18. Vertical sleeves 19 are supported by the flanges 17, 18 and define guides for piston rods 20 of the respective pumping units, the piston rods 20 extending slidably through the guide sleeves. The lower ends of the piston rods carry cam follower rollers 21 which rest on the cam face of cam 8 and are journalled on axle pins 22. Fastened to the underside of flange 18 is a guide cylinder 23 having longitudinal slots 24 into which extensions of the respective axle pins 22 project to prevent rotation of the piston rods in their guide sleeves and hence to maintain the axles of the rollers 21 radial to the rotation axis. It will be understood that the height of the cam face varies smoothly around the cam so that, when the turret, is rotated the piston rods 20 are reciprocated.

Figure 2:
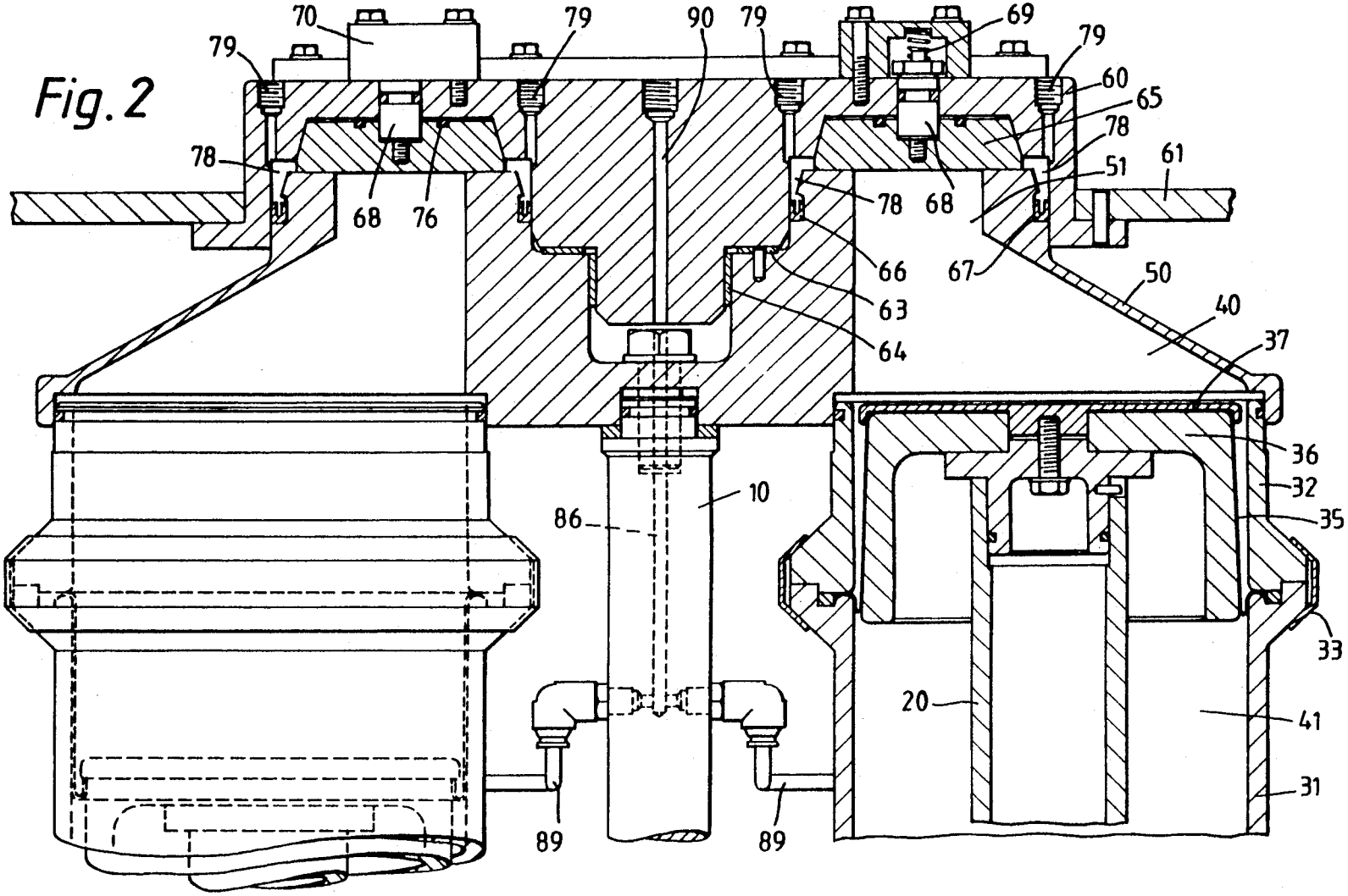
FIG. 2 is an enlarged, more detailed view showing part of the pump of FIG. 1.
Figure 3:
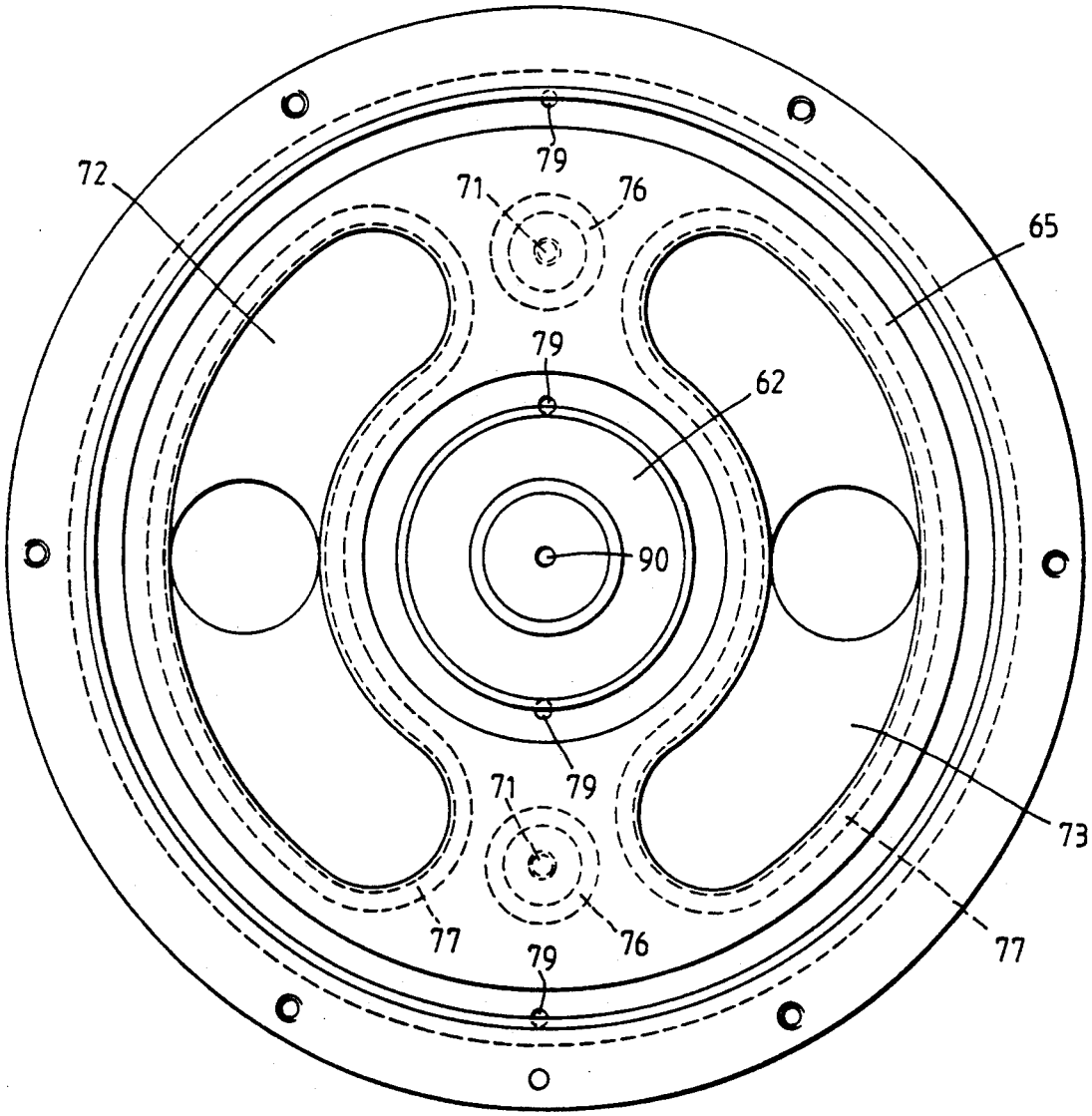
FIG. 3 is an underneath plan of the top member of the pump of FIG. 2 with the sealing ring in position.

The flange 17 is in horizontal alignment with a surrounding annular ring of the stationary frame, a running clearance being provided between these parts, but a seal may be provided between them for isolating the lower driving section of the pumps from the upper pumping section. Supported on the upper side of flange 17 is a circular locating plate 30 defining respective seats for the lower ends of the cylinders of the pumping units. Each cylinder comprises a lower section 31 secured to the plate 30, and an upper section 32 held in firm engagement with the lower section by a clamping ring 33 extending around their abutting end portions Clamped between the cylinder sections is the peripheral bead of a rolling diaphragm 35, whereby this diaphragm serves additionally to seal the cylinder sections together at the connection between them. The central portion of the diaphragm rests on the end face of a piston 36 fixed to the upper end of the piston rod 20. As shown in FIG. 2, the diaphragm is clamped to the piston by a clamp plate 37 to hold it securely in position to ensure the proper rolling action between the piston and cylinder as the piston is reciprocated. The rolling diaphragm and piston separate an upper pumping chamber 40 from a lower chamber 41 defined in the cylinder and to which a vacuum is applied, as described in more detail below, in order to assist the correct operation of the rolling diaphragm as well as to ensure that any leakage passing the diaphragm will be outwardly from the pumping chamber 40 to preclude any risk of contamination of the product being pumped.

Attached to the upper end of the drive shaft 10 and closing the upper ends of the cylinders is a top member 50 of the turret. The member 50 is provided with an inlet/outlet port 51 for each pumping chamber, these ports opening at an annular sealing face which lies in a plane normal to the rotation axis. A non-rotatable manifold assembly is carried on the frame 1 and serves to connect the ports 51 to stationary inlet and outlet conduits 55, 56. The manifold assembly includes a main member 60 secured to a horizontal frame plate 61 supported by the columns 7, and the member 60 has a central hub 62 received in a stepped bore in the top member 50 of the turret, the latter member being journalled on the hub by plain axial and cylindrical bearings 63, 64. An annular groove is provided in the underside of the manifold member 60 around the hub 62, and fitted into the bottom of the groove is a sealing ring 65. The annular upper end of the turret member 50 also engages in the groove, inner and outer peripheral elastomeric seals 66, 67 being interposed between the members 50 and 60. The sealing ring 65 is made of a low friction material, such as polytetrafluorethylene, and is arranged to make face-to-face sealing contact with the uppermost sealing face of the member 50. The sealing ring is prevented from rotating by pins 68 spaced apart around the ring at diametrically opposite positions and urged downwardly by coil springs 69 acting between enlarged heads provided on the pins and spring enclosures 70 bolted onto the top of the manifold member 60. Thus the pins 68 which are screwed into blind holes 71 in the sealing ring serve to retain the ring in correct rotational alignment with the manifold member. Two through openings or slots 72, 73 are provided in the ring 65 and are arcuate, or more exactly part-annular shaped. These slots register with corresponding arcuate slots in the manifold member 60, and connection pieces 74, 75 fixed to the top of member 60 connect the slots to the respective conduits 55, 56. The slots 72, 73 are so positioned around the sealing ring 65 that when the turret 11 rotates each of the ports 51 will communicate alternately with the slot 72 and the slot 73, thereby being connected alternately to the inlet and outlet conduits 55, 56. Furthermore, the slots 72, 73 are so located with respect to the angular disposition of the cam 8, that the port 51 of each pumping unit 15 is moving over the inlet slot 72 as its piston is moving downwardly, for product to flow from the inlet conduit 55 into the pumping chamber 40, and the port 51 is moving over the slot 73 as the piston is moving upwardly for product to be expelled from the pumping chamber to the outlet conduit 56. By suitable configuration and dimensioning of the slots 72, 73 together with the shaping of the cam 8, a constant, pulse free overall flow of product through the pump is possible.

The upper face of the sealing ring is provided with grooves to accommodate O-ring seals 76, 77 which extend around the location pins 68 and around the slots 72, 73. By becoming compressed between the sealing ring 5 and the manifold member 60, these seals 76, 77 act to bias the sealing ring 65 downwardly into firm abutment with the sealing face of the turret top member, assisted to a small extent by the springs 69 which press the pins 68 downwards.

Surrounding the sealing interface between the top member 50 of the turret and the sealing ring 65, both inwardly and outwardly of the latter are annular cavities 78 providing steam barriers. Leakage from the cavities between the member 50 and the manifold member 60 is prevented by the elastomeric seals 66, 67 and for supplying steam to the cavities ports 79 are provided in the manifold member 60. In use of the pump, steam delivered to the cavities 78 cools and condenses so that the cavities become filled with sterile condensate which is held under pressure and trapped in the cavities by non-return valves (not shown) so that it is impossible for product being pumped to leak into the steam barriers between the sealing faces of the ring 65 and the turret member 50.

To facilitate cleaning and sterilizing operations, the cooperating surfaces of the sealing ring 65 and turret member 50 can be separated. For this purpose the entire manifold assembly is raised by lifting the frame plate 61. The columns 7 of the frame 1 each comprise a vertical rod 80 with a screw threaded lower end portion which is screwed into a sleeve 81 fixedly mounted on the base plate 5. Thus, rotation of the rods 80 causes them to be driven up and down. Mounted on the upper ends of the rods 80 are pinions 82 which are axially and rotational fast with the respective rods. Each pinion 82 is rotatable relative to the plate 61, but the plate is held to move axially with the pinions. An endless chain 83 is trained around the four pinions 82 so that they are constrained to rotate in unison, and one of the rods is provided with an extension which protrudes through a top plate of the frame and carries an adjustment hand wheel 84. From the foregoing description it will be appreciated that rotating the wheel 84 in one direction will cause the plate 61 and the manifold assembly to be raised relative to the pump turret 11, due to the rods 80 being unscrewed out of the sleeves 81, and rotation of the wheel in the opposite direction cause the manifold assembly to be lowered due to the rods being screwed into the sleeves 81.

Figure 4:
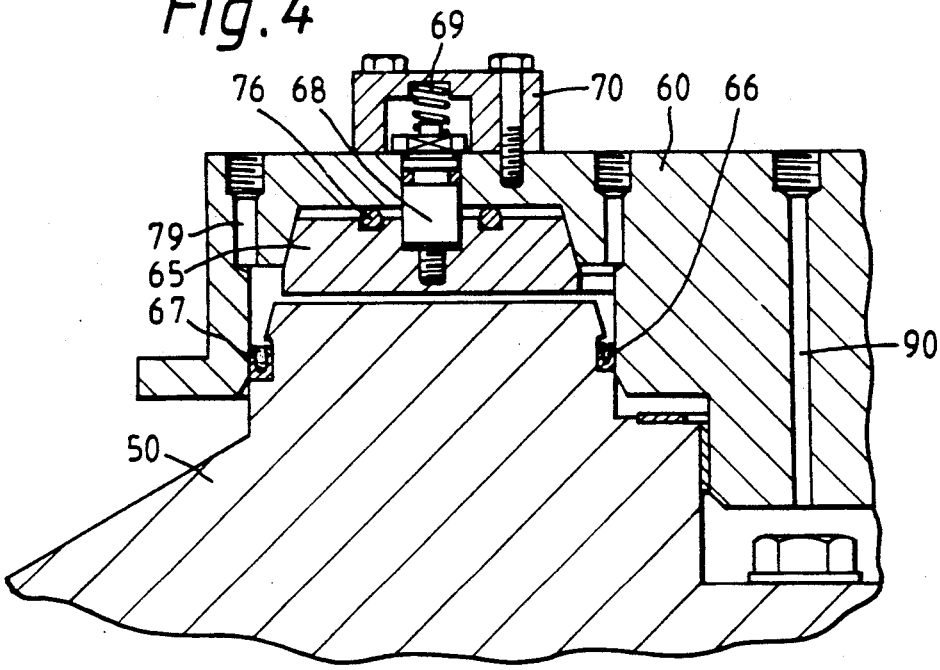
FIG. 4 is a detailed view corresponding to part of FIG. 2 but showing the pump adjusted for cleaning-/serialization.

When the manifold assembly is raised the pins 68, due to the action of the springs 69, first push down the sealing ring 65 so that the 0-ring seals 76, 77 are moved out of contact with the manifold member 60, but then the heads of the pins 68 bottom on the upper surface of the manifold member 60, to stop further downward movement of the sealing ring and hence cause its sealing face to become separated from that of the turret member 50, as shown in FIG. 4. It may be noted that the member 50 remains sealed to the manifold member 60 when the manifold assembly is raised for serialization due to the elastomeric seals 66, 67. Nonetheless, all the surfaces and seals associated with the sealing ring 65 are exposed for contact with cleaning and sterilizing solutions.

During sterilizing, with the manifold assembly raised as described, the pump is operated so that the turret is rotated at a slow speed and superheated water is passed through the pump, via the inlet and outlet conduits 55, 56. The steam supply to the steam barrier cavities 78 is also maintained during cleaning periods. In this way all the seal surfaces, in addition to those surfaces normally contacted by product flowing through the pump, are effectively and efficiently sterilized. At the end of a sterilizing period the manifold assembly is, of course, lowered again by appropriate manual rotation of the wheel 84, before recommencing pump operation with product.

The ability to raise and lower the manifold assembly can also facilitate maintenance and servicing of the pumps, especially in respect of the rolling diaphragms 35. Provision may be made for the top member 50 of the turret to be fixed to the manifold assembly, such as by means of bolts or screws passed downwardly through the plate 61 and engaged in tapped holes in the member 50. Upon raising the manifold assembly, the member 50 will also be raised allowing access to the upper cylinder sections 32. The sections 32 can then be removed (after removal of the clamping rings 33), so providing access for inspection and/or replacement of the rolling diaphragms 35.

As mentioned above, a vacuum is applied to the chambers 41 of the pumping units on the underside of the pistons and rolling diaphragms. For this purpose the drive shaft 10 has a blind bore 86 in its upper end portion, the inner end of this bore being connected to radial ports which lead to the respective cylinders of the pumping units. The radial ports may register with radial ducts defined in the cylinder locating plate 30, as shown in the schematic representation of FIG. 1, or as shown in FIG. 2 connection pipes 89 with suitable end unions may be employed to connect the radial ports in the shaft to vacuum ports (not shown) provided in the lower cylinder sections at a level below the rolling diaphragms when the pistons are at their bottom dead center positions. Seals not shown in FIG. 1 are included between the plate 30 and the flange 17, between the plate 30 and the cylinder section 31, and between the piston rods 20 and the guide sleeves 19 in order to minimize the vacuum consumption. Applying the vacuum to the underside of the rolling diaphragms ensures their correct rolling action. In addition, if any leakage should occur past the diaphragm it will be in the direction out from the pumping chambers so that contamination of product by leakage into the pumping chambers will be precluded. Furthermore, the vacuum may be monitored so that a loss or reduction in the vacuum level will indicate a seal failure and provide a warning of a pump malfunction. For connecting the bore 86 to the vacuum source an axial through bore 90 extends through the central hub 62 of the manifold member 60.

The pump operation will be apparent from the preceding description. The steam and vacuum sources are connected to ports 79 and 90 respectively. The turret is set in rotation by the drive motor 4 through the reduction gear 9 and the chain drive system 12–14. The motor may be controlled by an electronic variable speed unit, allowing the speed to be set to a required pumping capacity to match with other components of the food handling plant, e.g. a UHT treatment plant, of which the pump forms part. Alternatively, the control unit may be linked with other process control equipment. As the turret 11 rotates the cam 8 and cam follower rollers 21 cause the pistons 36 to reciprocate within the cylinders of the respective pumping units 15, and product is drawn into a pumping chamber 40 through the inlet slot 72 as the piston moves downwardly, i.e. the volume of the chamber 40 is increasing, and product is expelled through the outlet slot 73 when the piston is driven upwards and the volume of the chamber 40 is reducing. The downward displacement of the piston and rolling diaphragm during the induction stroke is aided by the vacuum. However, the cam and cam follower combination could be designed to provide positive drive of the pistons in both direction if it were desired to drive the pistons mechanically to assist in drawing product into the pumping chambers as well exhausting the product from the chambers.

When the plant is to be cleaned the flow of product is interrupted and cleaning solutions/sterilizing fluid is instead passed through, with the pump being operated at slow speed and the manifold assembly raised as described hereinabove for serialization.

The pump described and depicted in the drawings is capable of providing a pulse free product flow at pressures up to 5 bar and with flow rates up to 2000 l/hr. It can handle product containing particles of a size up to 25 mm and can be easily adapted to cope with even larger pieces of solids. The pump is fully sterilizable, using superheated water, and is cleanable in place to standards demanded by the food industry. The maintenance requirements are minimal and routine servicing demands are confined to lubrication of the lower drive parts, in particular the cam follower rollers and the drive shaft bearings. In that connection it is to be observed that the drive parts are housed within a lower section of the pump housing, which section can be totally enclosed and sealed to be isolated from the product handling components which are all accommodated in the upper section of the machine.

A pump of modified construction is illustrated in FIGS. 5 to 8. Except as described below, however, the pump is as described above in connection with the first embodiment. For ease of understanding, where pump components referred to below have corresponding parts in the first embodiment they are referred to by the same reference numeral preceded by 1. In the modified pump the top member 150 of the turret has a stepped axial through bore in which is mounted a cross-porting and valve assembly. This assembly includes a valve body 200, a main cylindrical part of which is received in the larger diameter section of the through bore in member 150. Formed within the body 200 is a cylindrical valve cavity 201 which is communicated with the pumping chambers 140 through respective ports 202 in the body 200 and corresponding radial ports 204 provided in the member 150 and registering with the ports 202. 0-ring seals 205 are included to seal the body 200 to the member 150 around the ports 202. The body 200 is held fixed within the member 150 by a clamp plate 207 bolted to the member 150, and as may be clearly seen in FIG. 5, the drive shaft 110 is engaged with the valve body 200. The manifold member 160 has in place of a central hub an integral sleeve portion 162 which extends into the upper section of the bore through the turret top member 150, this sleeve portion being sealed to the member 150 by the inner elastomeric seal 166. The valve body 200 includes a tubular extension 208 which projects upwardly from the main part of the body and passes through the sleeve portion 162 to protrude slightly at the upper side of the manifold member 160. At its free upper end the body extension 208 is closed by an end plug 209 fastened by screws and sealed to the extension by an 0-ring 210. Another O-ring 211 seals the extension 208 to the manifold member 160, and a plain cylindrical bearing 164 is interposed between the extension 208 and the sleeve portion 162 for journalling the turret with respect to the manifold member 160.

Figure 5:
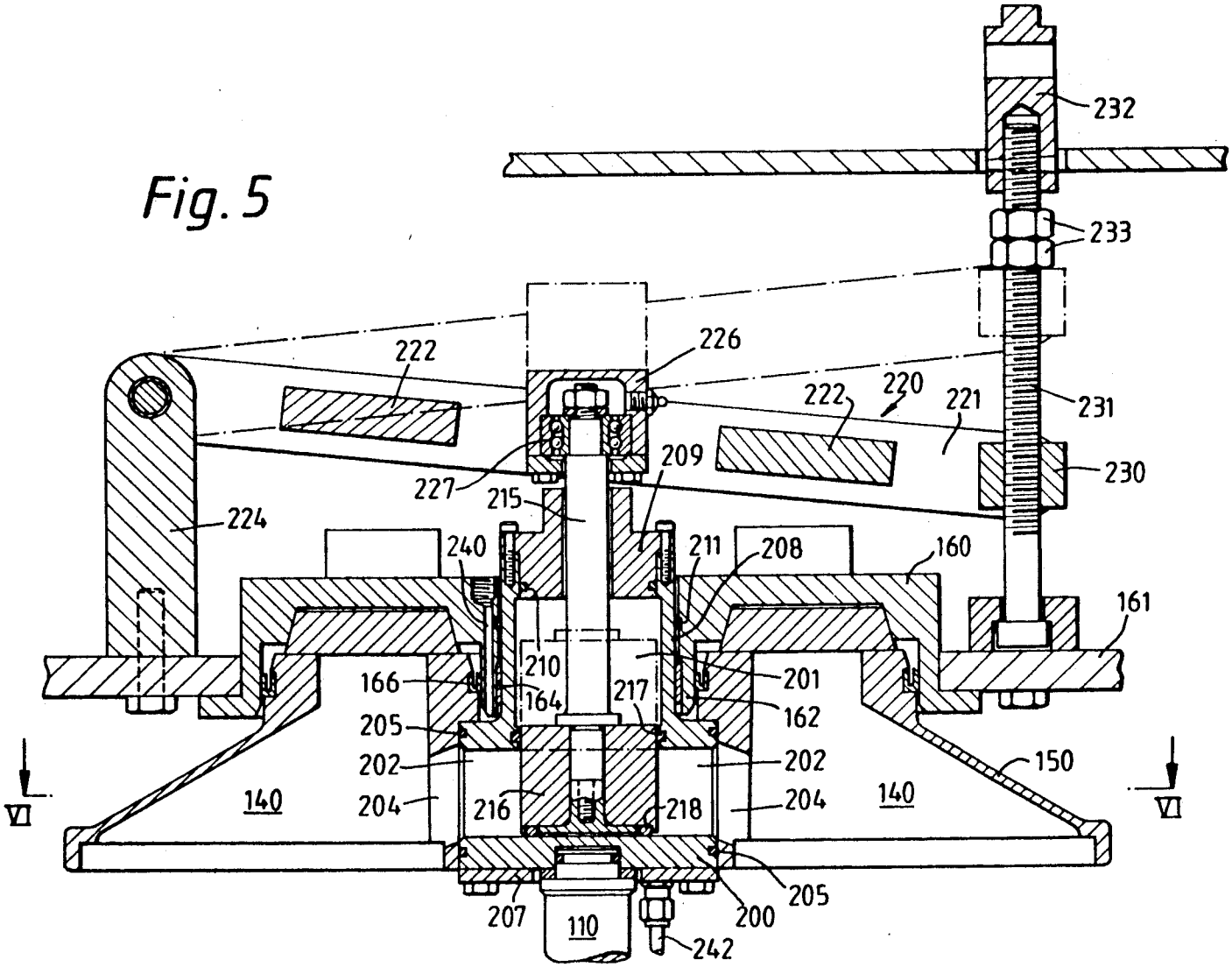
FIG. 5 is a cross-section similar to that of FIG. 2 but illustrating a modified construction.
Figure 6:
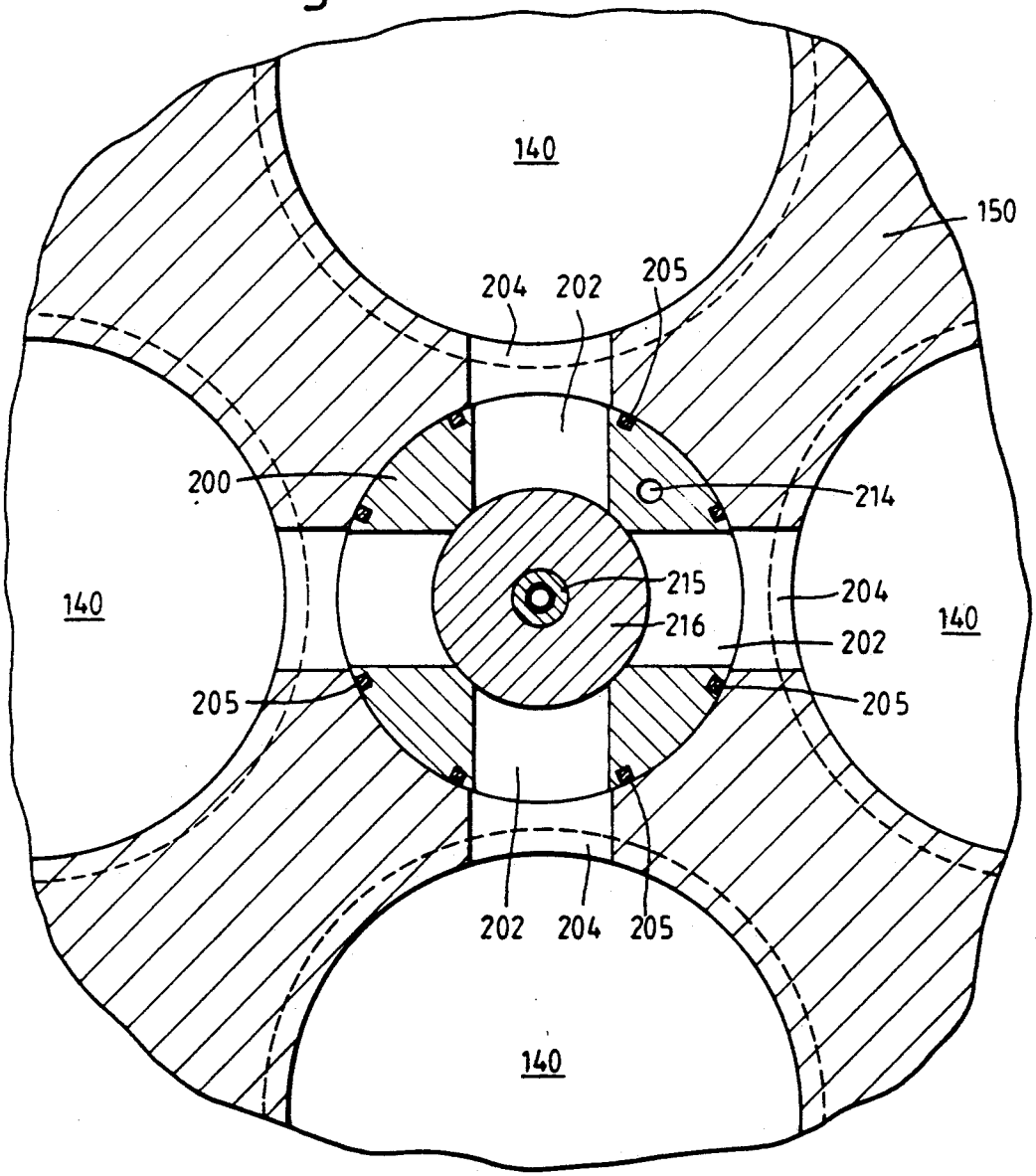
FIG. 6 is a section along the line VI—VI in FIG. 5.
Figure 7:
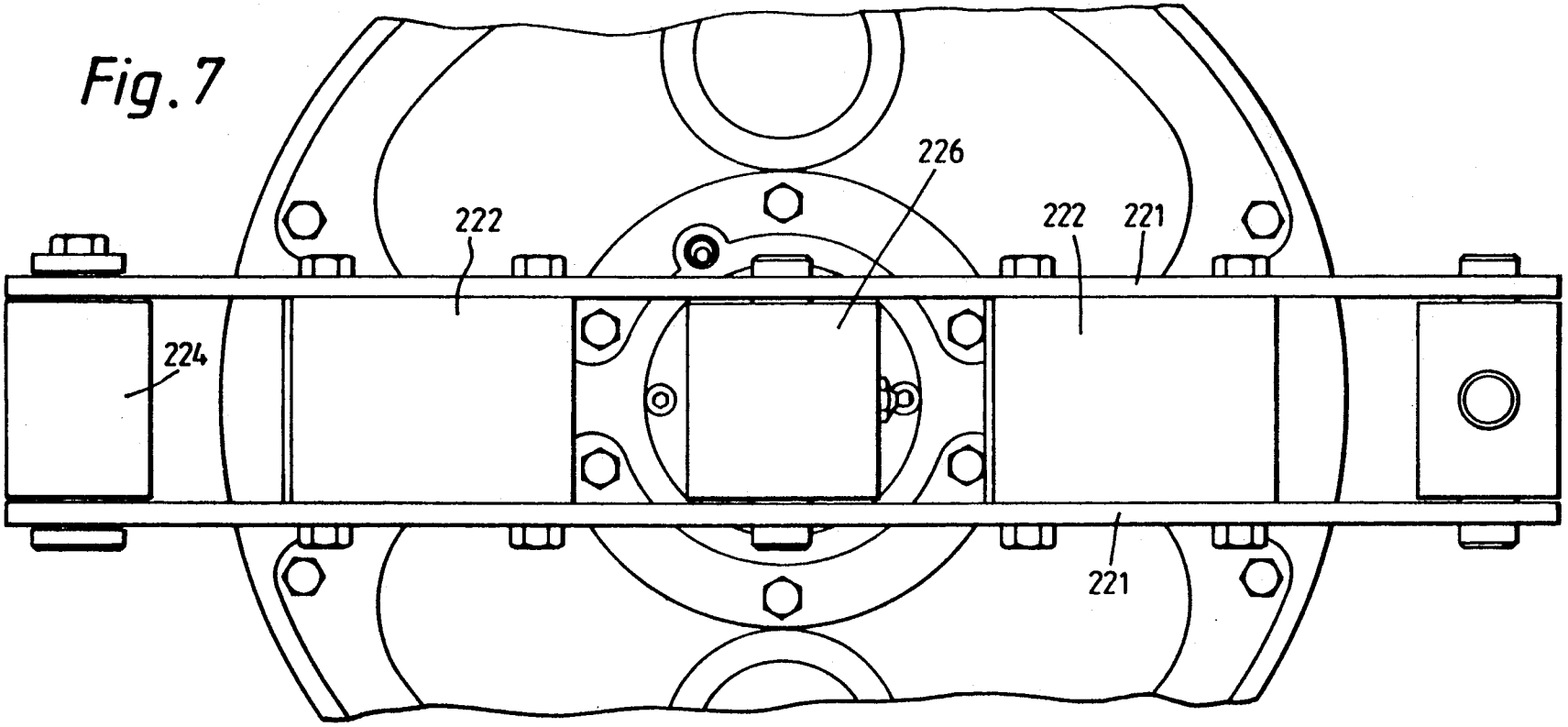
FIG. 7 is a part plan view of the pump of FIGS. 5 and 6.

A valve stem 215 extends through the end plug 209 and carries a cylindrical valve member or piston 216 within the valve cavity. The body 200 defines an annular land with a groove accommodating a O-ring 217 for sealing around the piston a small distance above the ports 202 when the piston occupies a lowermost, i.e. closed position as shown in FIG. 5. In this position of the piston an end face seal 218 fitted to the piston engages and seals the piston against the lower end face of the valve cavity. Consequently, with the piston in this valve closed position, communication between the ports 202 and hence between the pumping chambers 140, is interrupted by the piston. The valve piston 216 can be raised for cleaning and serialization of the pump as explained in more detail below, for which reason the valve stem is coupled to an actuating lever 220. The lever is of bifurcated form having a pair of side arms 221 secured rigidly in spaced parallel relationship by being bolted to spacer blocks 222. At one end the lever is pivoted to a stanchion 224 received between the lever arms and fixed on the frame plate 161. Pivoted between the lever arms intermediate their ends is a bearing block 226 housing a roller bearing 227 to the inner face of which the valve stem 215 is connected. It will be appreciated that the valve assembly, including the valve body 200, the piston 216 and the valve stem, all rotate as they form parts of the pump, turret, and the bearing 227 allows free rotation of the valve stem 215 relative to the actuating lever.

At the end opposite its pivotal mounting the lever carries a nut 230 pivoted between the lever arms and threaded onto a lead screw 231. The lower end of the lead screw is held to the frame plate 161 whereas its upper end is fitted with a device 232 engageable by a tool, such as a spanner or tommy bar for rotating the lead screw. Nuts 233 can be provided on the lead screw to form stops limiting the movement of the actuating lever.

It will be seen that rotation of the lead screw 231 in one direction will pivot the valve actuating lever upwardly to the position indicated in broken line whereby the valve piston will be raised so that its lower end face will lie level with the bottom end of the sealing land in the valve cavity, also as illustrated in broken line in FIG. 5. By opening up the connection between the cross-flow ports 204, the pumping chambers are brought into communication. It has been found that by interconnecting the pumping chambers in this way during cleaning periods, an improved circulation of clearing solution is obtained within the pump. In addition to the greater flow rate of cleaning solution obtained due to some of the solution passing from the inlet to the outlet through the cross-over passages, it appears better cleaning conditions are created through increased turbulence of the cleaning liquid within the pump.

Figure 8:
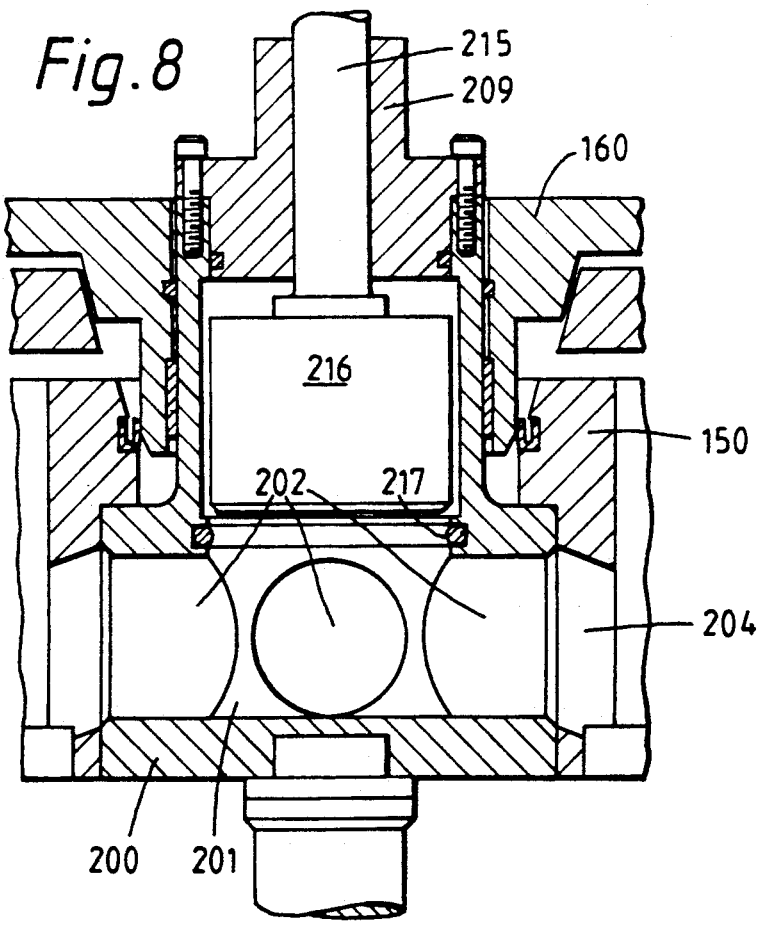
FIG. 8 is a detailed sectional view showing the pump of FIG. 5 adjusted for serialization.

For additional cleaning and/or serialization of the pump, the frame plate 161 will be raised in the same manner as described in relation to the first embodiment. Because the valve actuating lever is supported on the plate 161, the piston 216 will be lifted a small extra distance so that its bottom face is moved to a level above the sealing land in the valve cavity, as illustrated in FIG. 8. Thus, it is ensured that the cylindrical surface of the valve piston and the seal 217 are cleaned/sterilized by the circulating fluid.

To prepare the pump again for normal working, the frame plate 161 is lowered, and the lead screw 231 is turned to pivot the valve actuating lever downwardly until the piston seal 218 is seated once again against the end wall of the valve cavity was in FIG. 5.

It may be noted that in the modified embodiment of FIGS. 5–8 an alternative arrangement is necessary for connecting the vacuum source to the chambers defined on the underside of the rolling diaphragms in the pumping chambers. As shown, a duct 240 is formed through the manifold member 160 and its sleeve portion 162 to open into an annular space enclosed by the turret member 150, the valve body 200 and the manifold member 160. A further duct 241 extends vertically through the main part of the body 200 from the said annular space, and a vacuum pipe 242 is connected to this duct at its lower end. Branches from the pipe 242 are connected to the pump cylinders in the same way as the pipes 89 in FIG. 2.

In the embodiment of FIGS. 5–8, the turret member 150 may carry bearing blocks arranged to engage and run against the rim of the manifold member 160, these blocks constituting stops to avoid the manifold member being clamped down too tightly onto the turret for smooth trouble free operation of the pump.

We claim:

1. A pump comprising stationary cam means extending about an axis, a rotor assembly rotatable about said axis and including a plurality of pumping units distributed around said axis and having respective cam follower means cooperating with the cam means to be reciprocated substantially parallel to said axis for operating the pumping units upon rotation of the rotor assembly, the pumping units having pumping chambers with fluid ports opening at a sealing face and at a radial distance from said axis, and non-rotatable manifold means including a sealing member contacting said sealing face and having slots therein for communicating the ports with fluid supply and exhaust conduits as the rotor assembly is rotated, the sealing face and the sealing member defining an interface which is planar and perpendicular to said axis and is surrounded by a closed cavity having means for supplying barrier fluid under pressure thereto.

2. A pump according to claim 1, wherein the sealing face and said sealing member are annular and cavities for receiving barrier fluid are formed around the inner and outer peripheries of the interface therebetween.

3. A pump according to claim 1, wherein the sealing member is provided with two part-annular shaped slots spaced apart around said axis and respectively communicating with the supply and exhaust conduits.

4. A pump according to claim 1, wherein the sealing member is urged into sealing abutment with the sealing face by resilient means.

5. A pump according to claim 3, wherein the resilient means is constituted by seals positioned between the sealing member and a manifold member supporting the sealing member.

6. A pump according to claim 1, wherein the rotor assembly and the manifold means are supported by a frame, and means are provided for displacing the manifold means axially relative to the rotor assembly to enable the sealing member to be moved out of contact with the sealing face for cleaning/sterilizing the contact faces.

7. A pump comprising stationary cam means extending about an axis, a rotor assembly rotatable about said axis and including a plurality of pumping units distributed around said axis and having respective cam follower means cooperating with the cam means to be reciprocated substantially parallel to said axis for operating the pumping units upon rotation of the rotor assembly, the pumping units having pumping chambers with fluid ports opening at a sealing face and at a radial distance from said axis, and non-rotatable manifold means including a sealing member contacting said sealing face and having slots therein for communicating the ports with fluid supply and exhaust conduits as the rotor assembly is rotated, said manifold means including a member having an annular groove extending coaxially about said axis and accommodating said sealing member, said sealing face being defined at the end of a rotor part received in said groove, and wherein elastomeric seals are located between said rotor part and side walls of the groove.

8. A pump according to claim 7 wherein the sealing member is held against rotation relative to the manifold member by at least one pin attached to the sealing member and permitting limited axial movement of the sealing member away from the manifold member.

9. A pump according to claim 8, wherein said at least one pin is acted upon by spring means for urging the sealing member away from the manifold member.

10. A pump according to claim 7 wherein the sealing member is made of a material having a low coefficient of friction.

11. A pump according to claim 7, wherein the pumping units comprise piston and cylinder assemblies.

12. A pump according to claim 11, wherein the piston and cylinder assemblies are provided with rolling diaphragms partially confining the pumping chambers.

13. A pump comprising stationary cam means extending about an axis, a rotor assembly rotatable about said axis and including a plurality of pumping units distributed around said axis and having respective cam follower means cooperating with the cam means to be reciprocated substantially parallel to said axis for operating the pumping units upon rotation of the rotor assembly, the pumping units having pumping chambers with fluid ports opening at a sealing face and at a radial distance from said axis, and non-rotatable manifold means including a sealing member contacting said sealing face and having slots therein for communicating the ports with fluid supply and exhaust conduits as the rotor assembly is rotated, said pumping units comprising piston and cylinder assemblies which include rolling diaphragms partially confining the pumping chambers, each piston and cylinder assembly having a closed chamber on a side of the diaphragm remote from the pumping chamber, and wherein means are provided for connecting the closed chamber to a vacuum source.

14. A pump according to claim 13, wherein each piston and cylinder assembly has an axially fixed cylinder and a piston received in the cylinder and attached to a piston rod coupled to the cam follower means.

15. A pump according to claim 13, wherein the rotor assembly comprises a central drive shaft and the vacuum connecting means comprises a bore in said shaft.

16. A pump according to claim 15, wherein the vacuum connecting means further comprises an axial through bore extending in a manifold member and axially aligned with said shaft bore.

17. A pump comprising stationary cam means extending about an axis, a rotor assembly rotatable about said axis and including a plurality of pumping units distributed around said axis and having respective cam follower means cooperating with the cam means to be reciprocated substantially parallel to said axis for operating the pumping units upon rotation of the rotor assembly, the pumping units having pumping chambers with fluid ports opening at a sealing face and at a radial distance from said axis, and non-rotatable manifold means including a sealing member contacting said sealing face and having slots therein for communicating the ports with fluid supply and exhaust conduits as the rotor assembly is rotated, each pumping unit including a piston and cylinder assembly which has an axially fixed cylinder and a piston received in the cylinder and attached to a piston rod coupled to the cam follower means, the piston rod being guided for longitudinal displacement in a guide sleeve carried by support means fast for rotation with a drive shaft of a rotor assembly.

18. A pump according to claim 17, wherein the rotor assembly includes longitudinally extending guide means, and the cam follower means engage with said guide means for maintaining the cam follower means aligned with the cam means during rotation of the rotor assembly.

19. A pump according to claim 7, wherein the cam means defines an axially directed annular cam face and the cam follower means comprise rollers.

20. A pump comprising stationary cam means extending about an axis, a rotor assembly rotatable about said axis and including a plurality of pumping units distributed around said axis and having respective cam follower means cooperating with the cam means to be reciprocated substantially parallel to said axis for operating the pumping units upon rotation of the rotor assembly, the pumping units having pumping chambers with fluid ports opening at a sealing face and at a radial distance from said axis, non-rotatable manifold means including a sealing member contacting said sealing face and having slots therein for communicating the ports with fluid supply and exhaust conduits as the rotor assembly is rotated, said rotor assembly and said manifold means being supported by a frame which includes a base, a plurality of parallel elongate supports fastened to the base and a plate carried on the supports and adjustable thereon towards and away from the base, the manifold means being mounted on the frame plate, and including means for displacing the manifold means axially relative to the rotor assembly to enable the sealing member to be moved out of contact with the sealing face for cleaning and sterilizing of the contact faces.

21. A pump according to claim 20, wherein the base mounts the cam means and a bearing housing, the rotor assembly having a drive shaft journalled in the bearing housing, and drive means for rotating the shaft supported on said base.

22. A pump comprising stationary cam means extending about an axis, a rotor assembly rotatable about said axis and including a plurality of pumping units distributed around said axis and having respective cam follower means cooperating with the cam means to be reciprocated substantially parallel to said axis for operating the pumping units upon rotation of the rotor assembly, the pumping units having pumping chambers with fluid ports opening at a sealing face and at a radial distance from said axis, and non-rotatable manifold means including a sealing member contacting said sealing face and having slots therein for communicating the ports with fluid supply and exhaust conduits as the rotor assembly is rotated, said rotor assembly including an end member partly confining each pumping chamber and having the fluid ports therein, said rotor end member being journalled for rotation by a manifold member supporting the sealing member.

23. A pump according to claim 22, wherein the rotor end member has a stepped recess, a hub portion of the manifold member is received in said recess, and bearings are provided between confronting axial and cylindrical surfaces of the recess and hub portion.

24. A pump according to claim 22, wherein the rotor assembly includes means defining passages for interconnecting the pumping chambers, and valve means for closing said passages.

25. A pump according to claim 24, wherein said passages for connecting the pumping chambers open into said chambers through additional ports formed in said end member of the rotor assembly.

26. A pump according to claim 25, wherein said additional ports extend radially from a central bore in the end member, and a valve assembly is accommodated in said central bore.

27. A pump comprising stationary cam means extending about an axis, a rotor assembly rotatable about said axis and including a plurality of pumping units distributed around said axis and having respective cam follower means cooperating with the cam means to be reciprocated substantially parallel to said axis for operating the pumping units upon rotation of the rotor assembly, the pumping units having pumping chambers with fluid ports opening at a sealing face and at a radial distance from said axis, non-rotatable manifold means including a sealing member contacting said sealing face and having slots therein for communicating the ports with fluid supply and exhaust conduits as the rotor assembly is rotated, the rotor assembly including means defining passages for interconnecting the pumping chambers which open into said chambers through additional ports in said end member of the rotor assembly, said additional ports extending radially from a central bore in the end member, valve means for closing said passages comprising a valve assembly in said central bore, said valve assembly including a valve body having ports in radial alignment with said additional ports and communicating with a valve cavity, and a valve member movable in the cavity either to interrupt communication between said ports in the body or to allow free communication therebetween.

28. A pump according to claim 27, wherein the valve member is movable axially between open and closed positions.

29. A pump according to claim 28, wherein the valve member is carried by a valve stem, and the stem is coupled by a rotary bearing to actuating means for operating the valve member.

30. A pump according to claim 29, wherein the rotor assembly and manifold means are supported by a frame, means are provided for displacing the manifold means axially relative to the rotor assembly to enable the sealing member to be moved out of contact with the sealing face for cleaning/sterilizing the control faces, and the valve actuating means is mounted for movement with the manifold means, whereby displacing said manifold means to move the sealing member out of engagement with the sealing face causes further axial adjustment of the valve member.

31. A pump according to claim 30, wherein the actuating means is operable to move the valve member to an open position in which said valve member is sealed by sealing means to the valve body, and subsequent displacement of the manifold means causes the valve member to be retracted beyond said open position to expose said sealing means.

32. A pump comprising stationary cam means extending about an axis, a rotor assembly rotatable about said axis and including a plurality of pumping units distributed around said axis and having respective cam follower means cooperating with the cam means to be reciprocated substantially parallel to said axis for operating the pumping units upon rotation of the rotor assembly, the pumping units having pumping chambers with fluid ports, and non-rotatable manifold means for communicating the ports with fluid supply and exhaust conduits as the rotor assembly is rotated, the rotor assembly including passage means for interconnecting the pumping chambers, and means for closing said passage means during normal pumping operation of the pump and for opening said passage means during pump cleaning operations.

33. A pump according to claim 32, wherein the rotor assembly includes an end member confining partly each pumping chamber and having the fluid ports therein, and said passages for connecting the pumping chambers open into said chambers through additional ports formed in said end member.

34. A pump according to claim 33, wherein said additional ports extend radially from a central bore in the end member, and a valve assembly is accommodated in said central bore.

35. A pump according to claim 34. wherein the valve assembly comprises a valve body having ports in radial alignment with said additional ports and communicating with a valve cavity, and a valve member movable in the cavity either to interrupt communication between said ports in the body or to open up free communication therebetween.

36. A pump according to claim 35, wherein the valve member is movable axially between open and closed positions.

* * * * *